US007102632B2

(12) United States Patent
Siwinski

(10) Patent No.: US 7,102,632 B2
(45) Date of Patent: Sep. 5, 2006

(54) METHOD FOR SAVING POWER IN AN ORGANIC ELECTROLUMINESCENT DISPLAY

(75) Inventor: Michael J. Siwinski, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 742 days.

(21) Appl. No.: 09/874,147

(22) Filed: Jun. 5, 2001

(65) Prior Publication Data

US 2002/0180723 A1 Dec. 5, 2002

(51) Int. Cl.
*G09G 5/00* (2006.01)

(52) U.S. Cl. ..... 345/212; 345/213

(58) Field of Classification Search ..... 345/82, 345/83, 211–213, 76–81, 600–605, 1–3, 63, 345/20, 147–153, 102, 87, 77; 315/169.1–169.3; 713/320–324, 223, 224; 348/800, 803, 453, 348/441; 455/90; 438/28; 313/326, 503–506
See application file for complete search history.

(56) References Cited

U.S. PATENT DOCUMENTS 5,167,024 A * 11/1992 Smith et al. ..... 713/322
5,278,681 A 1/1994 Gitlin et al.
5,514,618 A * 5/1996 Hunter et al. ..... 438/30
5,537,650 A 7/1996 West et al.
5,576,723 A * 11/1996 Asprey ..... 345/3.1
5,598,565 A * 1/1997 Reinhardt ..... 713/323
5,774,257 A * 6/1998 Shibata et al. ..... 359/291
5,781,164 A * 7/1998 Jacobsen et al. ..... 345/87
5,790,096 A * 8/1998 Hill, Jr. ..... 345/600
5,944,829 A * 8/1999 Shimoda ..... 713/324
6,035,180 A * 3/2000 Kubes et al. ..... 455/575.1
6,088,066 A 7/2000 Westerman
6,140,986 A 10/2000 Wilkinson et al.
6,311,282 B1 * 10/2001 Nelson et al. ..... 713/324
6,320,325 B1 * 11/2001 Cok et al. ..... 315/169.3
6,366,025 B1 * 4/2002 Yamada ..... 315/169.3
6,424,326 B1 * 7/2002 Yamazaki et al. ..... 345/77
6,429,840 B1 * 8/2002 Sekiguchi ..... 345/88
6,472,804 B1 * 10/2002 Mueller et al. ..... 313/326
6,507,350 B1 * 1/2003 Wilson ..... 345/690
6,560,398 B1 * 5/2003 Roach et al. ..... 385/147
6,582,980 B1 * 6/2003 Feldman et al. ..... 438/28
6,603,469 B1 * 8/2003 Gettemy et al. ..... 345/211
7,009,338 B1 * 3/2006 D'Andrade et al. ..... 313/504
2002/0197511 A1 * 12/2002 D'Andrade et al. ..... 428/690
2005/0282036 A1 * 12/2005 D'Andrade et al. ..... 428/690

FOREIGN PATENT DOCUMENTS

JP 410091088 A * 4/1998
JP 2000-277257 * 6/2000

OTHER PUBLICATIONS

Thompson-Derwent Machine-Assisted Translation of JP10-91088-A.*

* cited by examiner

*Primary Examiner*—Bipin Shalwala
*Assistant Examiner*—Prabodh Dharia
(74) *Attorney, Agent, or Firm*—Andrew J. Anderson; Thomas H. Close

(57) ABSTRACT

A method of saving power in a color organic electroluminescent display of the type having color emitting elements with different light emitting efficiencies, includes the steps of: determining the color of the elements having the highest efficiency; converting a color digital image to be displayed on the display to a monochrome image; and displaying the monochrome image using the determined color elements.

10 Claims, 2 Drawing Sheets

METHOD FOR SAVING POWER IN AN ORGANIC ELECTROLUMINESCENT DISPLAY

FIELD OF THE INVENTION

This invention relates generally to organic electroluminescent displays, and more particularly, to a method for reducing the power consumed by an organic electroluminescent display panel.

BACKGROUND OF THE INVENTION

Full color organic electroluminescent flat panel displays such as organic light emitting diodes (OLEDs) consist of two dimensional arrays of discrete light emitting elements. A common configuration for such a device includes columns of alternating red, green and blue emitting elements. Another configuration includes closely placed triplets of light emitting elements, each triplet consisting of one each of a red, green and blue light emitting diode. Color organic electroluminescent flat panel displays are presently planned for wide use in battery powered portable electronic devices such as personal computers, digital assistants and cellular telephones. A common problem with such apparatus is the limited time of operation before the battery must be replaced or recharged. One approach to saving power is to automatically put the device into a minimum power usage sleep mode if there has been no active use of the device for a predetermined time. This approach however is not very useful if the device is continually in use. There is a need therefore for an improved method of conserving power

SUMMARY OF THE INVENTION

The need is met according to the present invention by providing a method of saving power in a color organic electroluminescent display of the type having color emitting elements with different light emitting efficiencies, that includes the steps of: determining the color of the elements having the highest efficiency; converting a color digital image to be displayed on the display to a monochrome image, and displaying the monochrome image using the determined color elements.

ADVANTAGES

The present invention has the advantage that power can be saved while continuing to use the display device.

DETAILED DESCRIPTION OF THE INVENTION

The present invention is directed to a method of conserving power in a portable OLED device. OLEDs create a color image by emitting colored light at each individual pixel site.

The OLED has a useful property in that the only light emitting elements that consume power are the light emitting elements that are turned on. In other words, the power consumed by the OLED device can be reduced by turning individual light emitting elements off. It is known that the various colors of OLED materials do not create light with the same efficiencies. The present invention takes advantage of this property to provide a method for displaying an image using the most efficient light emitting channel of the OLED device. This display mode saves power by turning off the less efficient color channels, and using the most efficient channel for displaying the image.

A typical active matrix OLED display has red, green and blue light emitting elements. When all of the light emitting elements are off, the display consumes a minimum of power, and the display appears black. When all of the light emitting elements are turned on, the red, green and blue light mixes, and the display appears white. The materials used to produce the different colors of light do not have the same light emitting efficiencies. Some of the materials will produce more light output than others, for a given amount of input current. For example, the green light emitting materials are often the most efficient, and may be as much as four or five times as efficient as the blue material, which is the least efficient.

Figure 1:
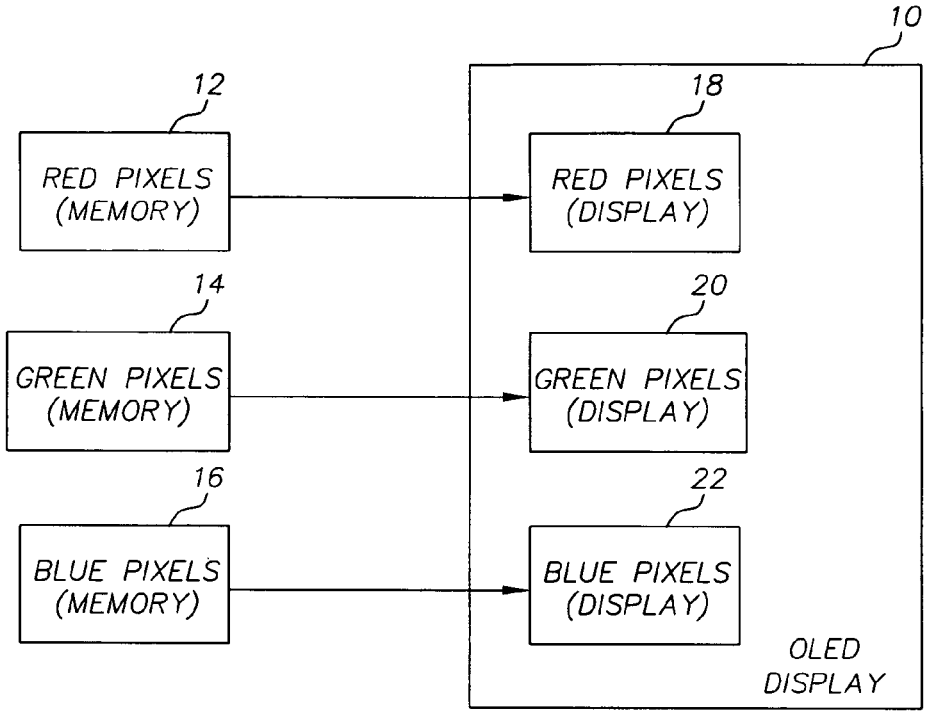
FIG. 1 (PRIOR ART)
FIG. 1 is a schematic diagram illustrating the normal full color operation of an organic electroluminescent display, according to the prior art.

FIG. 1 shows the normal mode of operation of a full color OLED display 10, the data from each color channel (12, 14, 16) is used to drive the corresponding colored light emitting elements (18, 20, 22) in the OLED display 10.

It is known that the luminance content of a colored image can be represented by adding together a weighted portion of each of the intensities of the red, green and blue components of the image. For example in one known technique for converting a color image to a monochrome image, the relative weighted amounts of red, green and blue used to produce a gray scale luminance value are:

$$\text{Luminance}=(3/16)*\text{red}+(9/16)*\text{green}+(2/16)*\text{blue} \quad (1)$$

Figure 2:
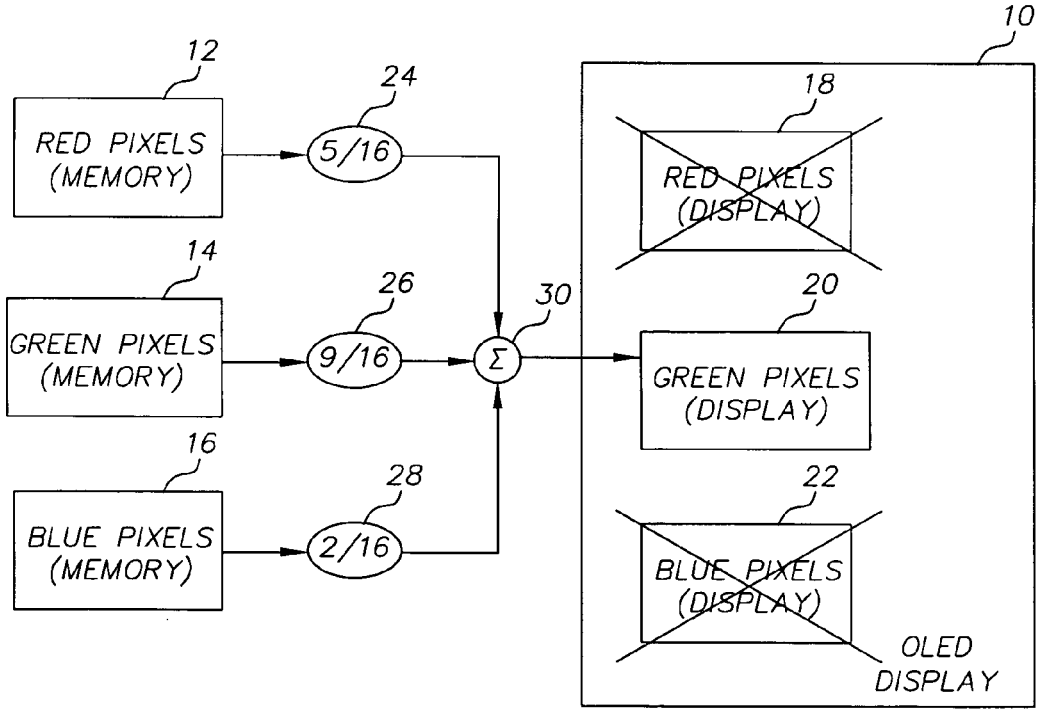
FIG. 2 is a schematic diagram illustrating the power saving mode of operation of an organic electroluminescent display according to the present invention.

FIG. 2 shows how the image data can be processed by multiplying the data in each channel by a fraction (24, 26, and 28) and summing (30) the processed channels to produce a weighted luminance sum, and that sum is used to drive one of the channels (e.g. the green channel) on the OLED display.

Figure 3:
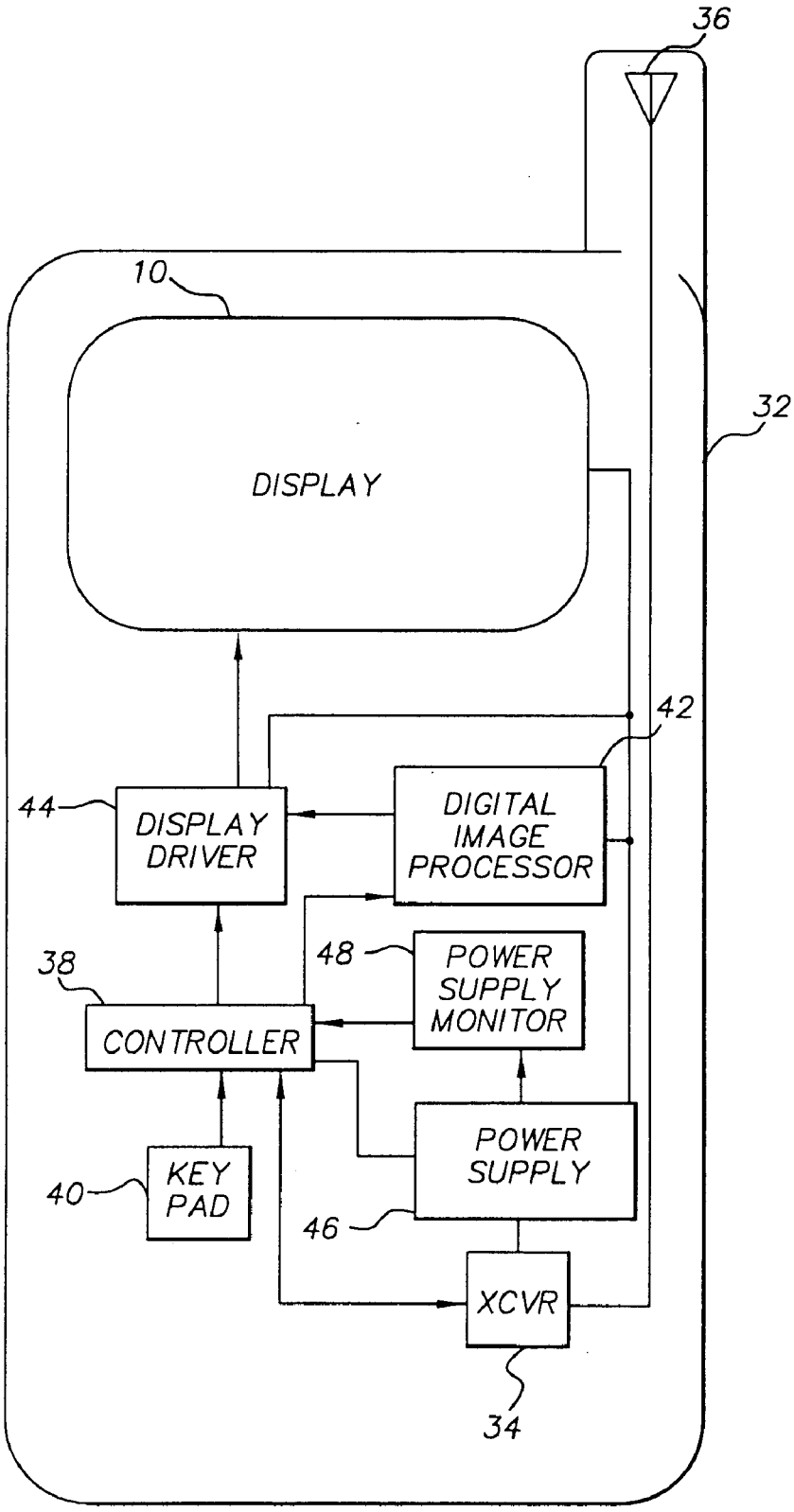
FIG. 3 is a schematic block diagram of a battery powered cell phone having an organic electroluminescent display capable of being operated in a power saving mode according to the present invention.

Referring to FIG. 3, in certain portable applications, such as a cellular telephone 32, it may be acceptable to switch from a full power, full color mode to a low power monochrome mode. The cell phone 32 includes a full color OLED display 10. A transceiver 34 is connected to an antenna 36 and a controller 38. The cell phone is operated by a keypad 40 connected to the controller. The controller sends signals to a digital image processor 42 that in turn sends processed digital image signals to a display driver 44 that drives the display. A power supply, such as a battery pack 46 supplies power to the components of the cell phone, including the display 10. A power supply monitor 48 is connected to the battery pack 46 and signals the controller as to state of charge of the batteries in the power supply.

When the battery pack 46 is low on stored power, it may be more important to use the remaining power to receive and transmit, than to display full color on the OLED display 10. This low power monochrome mode can be achieved by converting the full color RGB color image to a luminance only gray scale image as described above in the digital image processor 42, and displaying that monochrome image on the green light emitting elements (only) of the OLED display 10. The inefficient red and blue light emitting elements would all be turned off, and the image would be displayed on the efficient green light emitting elements. The low power mode of operation can be selected manually, for example by a code that is input into the keypad 40, or automatically by the controller in response to the signal provided by the power supply monitor 48.

The present invention is also useful in devices such as laptop computers and personal digital assistants, for example, by providing the option to switch to a power saving mode when doing tasks such as word processing that don't necessarily require full color.

The invention has been described in detail with particular reference to certain preferred embodiments thereof but it will be understood that variations and modifications can be effected within the spirit and scope of the invention.

PARTS LIST

10 OLED display
12 red color channel
14 green color channel
16 blue color channel
18 red pixel element
20 green pixel element
22 blue pixel element
24 multiply red channel data
26 multiply green channel data
28 multiply blue channel data
30 sum multiplied channel data
32 cell phone
34 transceiver
36 antenna
38 controller
40 keypad
42 image processor
44 display driver
46 battery pack
48 power supply monitor

What is claimed is:

1. A method of saving power in a color organic electroluminescent display of the type having color emitting elements with different light emitting efficiencies, comprising the steps of:

a) determining the color of the elements having the highest light emitting efficiency;

b) converting a color digital image to be displayed on the display to a monochrome image; and c) displaying the monochrome image using only the determined color elements.

2. The method claimed in claim 1, wherein the display is in a battery powered device, and further comprising the step of monitoring the power level of the battery, and converting to a power saving mode of operation when the battery power reaches a predetermined level.

3. The method claimed in claim 1, further comprising the steps of: providing a battery saving mode switch on a device that includes the color organic electroluminescent display, and switching to a battery saving mode using the mode switch.

4. The method claimed in claim 1, wherein the display has red, green, and blue light emitting elements and the determined color is green.

5. The method claimed in claim 4, wherein the step of converting a color digital image to a monochrome digital image comprises combining 5/16, 9/16, and 2/16 of the red, green and blue color signals, respectively.

6. A color organic electroluminescent display, comprising:

a) a plurality of differently colored light emitting elements having different light emitting efficiencies;

b) a digital image processing circuit for converting a color digital image to be displayed on the display to a monochrome image; and c) means for displaying the monochrome image using only the colored light emitting elements having the highest light emitting efficiency.

7. The display claimed in claim 6, wherein the display is in a battery powered device, and further comprising a power monitor for monitoring the power level of the battery, and a control circuit connected to power monitor for converting the display to a power saving mode of operation when the battery power reaches a predetermined level.

8. The display claimed in claim 6, further comprising a battery saving mode switch connected to the control circuit for switching to a battery saving mode.

9. The display claimed in claim 6, wherein the display has red, green, and blue light emitting elements and the light emitting elements with the highest light emitting efficiency color are green.

10. The display claimed in claim 6, wherein the digital image processing circuit converts a color digital image to a monochrome digital image by combining 5/16, 9/16, and 2/16 of the red, green and blue color signals, respectively.

* * * * *